United States Patent [19]

Bayne

[11] Patent Number: 4,486,999

[45] Date of Patent: Dec. 11, 1984

[54] CHECK RESISTING AND REINFORCING INSERT FOR WOOD POLE ENDS

[76] Inventor: Brian Bayne, S. 4333 Locust Rd., Spokane, Wash. 99206

[21] Appl. No.: 541,063

[22] Filed: Oct. 12, 1983

Related U.S. Application Data

[63] Continuation of Ser. No. 466,565, Feb. 15, 1983.

[51] Int. Cl.[3] ..... F16B 15/00

[52] U.S. Cl. ..... 52/514; 411/477

[58] Field of Search ..... 411/477, 478, 460; 403/406; 52/514

[56] References Cited

U.S. PATENT DOCUMENTS

| | | | |
|---|---|---|---|
| 293,646 | 2/1884 | Gerald | 411/460 X |
| 1,531,699 | 3/1925 | Johansson | 403/406 |
| 1,737,908 | 12/1929 | Beegle | 52/514 X |
| 2,080,962 | 5/1937 | Febrey | 411/478 |

FOREIGN PATENT DOCUMENTS

| | | | |
|---|---|---|---|
| 397960 | 7/1924 | Fed. Rep. of Germany | 52/514 |
| 80253 | 5/1934 | Sweden | 411/477 |

*Primary Examiner*—J. Karl Bell

*Attorney, Agent, or Firm*—Eugene M. Eckelman

[57] ABSTRACT

An open ended tubular body member has a continuous defining side wall formed of rigid sheet material of high tensile strength. This body member is arranged to be driven into the end of a wood pole longitudinally with the grain. The side wall is contoured to have a plurality of adjoining wall portions with adjacent ones of the wall portions being disposed angularly relative to each other and each arranged to intersect the growth rings of the wood in a diagonal direction. The device resists radial checking of the pole due to aging of the pole or moisture changes and also reinforces the pole whereby mounting bolts for brackets or cross arms are arranged to have a positive securement to a pole.

1 Claim, 5 Drawing Figures

CHECK RESISTING AND REINFORCING INSERT FOR WOOD POLE ENDS

This application is a continuation of application Ser. No. 466,565, filed Feb. 15, 1983.

BACKGROUND OF THE INVENTION

This invention relates to a new and novel check resisting and reinforcing insert for the ends of wood poles.

Wood poles are in common use for supporting utility lines by means of supporting brackets, cross arms, or other equipment. These brackets or the like are generally at the top of the poles and one of the major problems of such supporting arrangement is that when the poles are aged or are subjected to moisture change, either before or after installation of the brackets or cross arms, they develop checks or splits which generally lead radially inwardly from the outer surface. Thus, if mounting bolts for brackets or the like should extend through such checks, and particularly through oppositely aligned checks, a poor holding connection for the brackets or cross arms results.

In view of this problem, attempts have been made to reinforce the top end of utility poles. One solution has been to apply a cross bolt at right angles to the bolts holding the brackets or cross arms. Such a reinforcing method requires extra bored holes which of course is time consuming. Also these cross bolts have the disadvantage that the metal heads of the bolts as well as nuts and washers associated with the bolts are exposed. Such is not only unsightly but may cause electrical arcing and create problems with lighting.

SUMMARY OF THE INVENTION

According to the present invention and forming a primary objective thereof, a check resisting and reinforcing insert for the ends of wood poles is provided that employs a novel structure and one which accomplishes novel functions.

More particular objects of the invention are to provide an insert of the type described which is simplified and inexpensive to manufacture, which is easily applied to the ends of poles without appreciable manual labor, which prevents undesirable checking of the pole ends so as to insure a solid connection of bracket or cross arm mountings to the poles, and which has a minimum of exposed metal surface.

In order to accomplish such objectives, the insert comprises an open-ended tubular body member having a continuous defining side wall formed of rigid sheet material of high tensile strength. This body member has a top driving edge and a bottom piercing edge and is arranged to be driven edgewise into the end of a wood pole longitudinally of the grain. Importantly, the defining side wall of the body member is contoured thereabout to have a plurality of adjoining wall portions with adjacent ones of the wall portions being disposed angularly relative to each other and each arranged when the body member is embedded in a pole to intersect the growth rings of the wood in a diagonal direction. The piercing edge of the body member is beveled to form a sharpened edge, it being preferred that the bevel faces inwardly of the tubular body member.

The invention will be better understood and additional objects and advantages will become apparent from the following description taken in connection with the accompanying drawings.

DETAILED DESCRIPTION OF A PREFERRED EMBODIMENT

Figure 1:
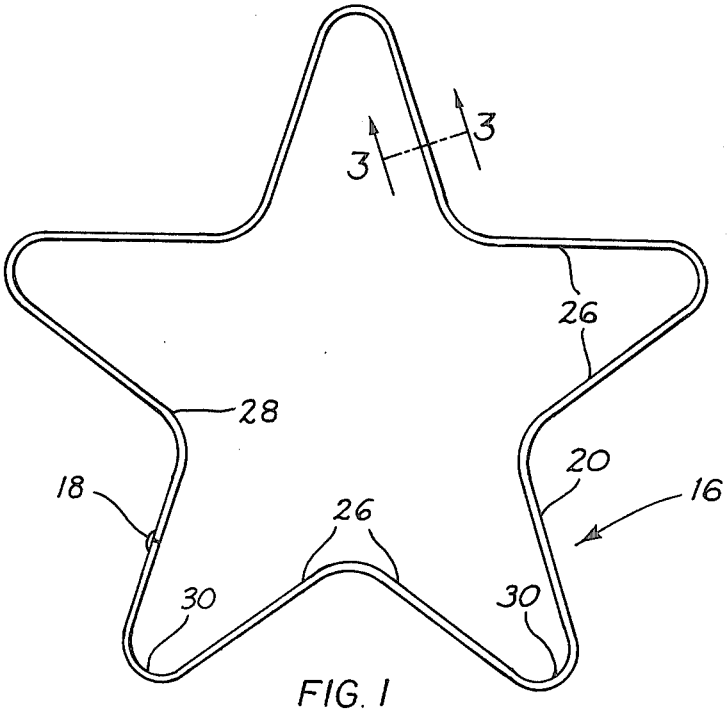
FIG. 1 is a top plan view of a check resisting and reinforcing insert of the instant invention.
Figure 3:
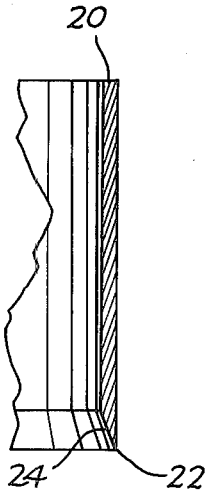
FIG. 3 is an enlarged fragmentary sectional view taken on the line 3—3 of FIG. 1.
Figure 2:
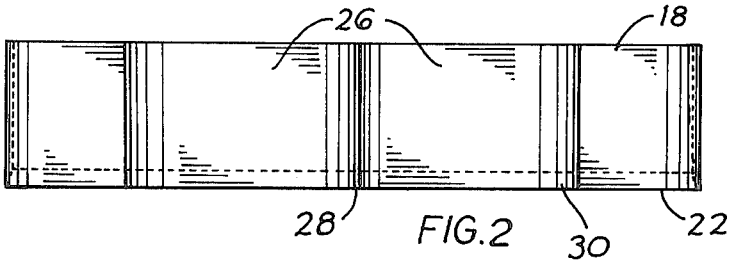
FIG. 2 is a side elevational view of the insert.
Figure 4:
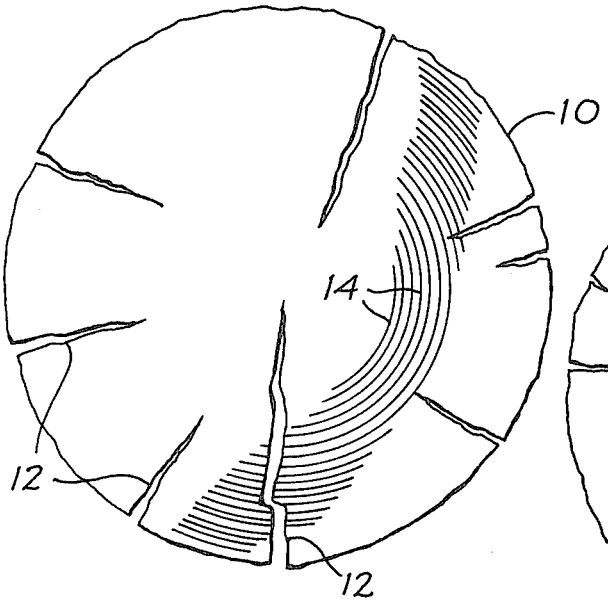
FIG. 4 is an end view of a conventional pole showing usual checking that may occur unless means are provided to stop the checking insert.

With reference first to FIG. 4, a log 10 is shown which has checks or cracks 12 resulting from the natural aging of the wood or from moisture changes. These checks extend radially inwardly from the periphery of the pole, and when mounting bolts are applied through the pole for brackets or cross arms, a weak mounting connection will result if the mounting bolts extend through one of the checks and particularly if such bolts extend through diametrically aligned checks. The numeral 14 designates the growth rings of the tree.

FIGS. 1–3 and 5 illustrate the insert of the invention. Such insert comprises an open ended tubular body member 16 having a continuous defining side wall formed of rigid sheet material or the like of high tensile strength. The body member comprises a closed structure which as an example may comprise sheet metal stamped or otherwise formed in a contour to be described in more detail hereinafter and having the ends of the stamping welded together at 18 to form a closed structure. The lateral dimension of the body member may vary according to the diameter of pole to which it is to be applied and its height from the top edge 18 to the bottom edge 20 may also vary as required. It is found that a lateral width between maximum outlines of the insert is generally slightly less or greater than six inches and that the height is approximately one inch to one and a quarter inch.

Figure 5:
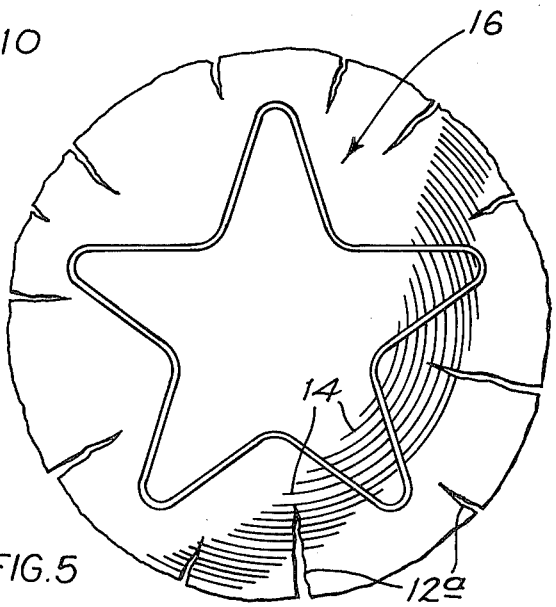
FIG. 5 is an end view of a pole having the present insert installed therein.

The top edge 20 of the insert comprises a driving edge for forcing the insert into the end of a log in a direction longitudinally with the grain, namely, into a position as shown in FIG. 5, and the bottom edge 22 has a bevel portion 24 to provide a sharpened piercing edge. Bevel 24 faces inwardly of the body member 16, and not only does such bevel provide a penetrating edge but it also applies an outward expanding force to the body member as it is driven in to securely hold it in the wood and particularly secure it to the wood enclosed therein.

The contour of the body member 16 is important for the purpose of eliminating checks or cracks in the pole resulting from aging or moisture changes and also for reinforcing the end of the pole. To accomplish the improved functions, the body member comprises a plurality of adjoining wall portions 26 with adjacent ones of these wall portions being disposed angularly relative to each other and also being arranged so that when embedded in the end of a pole parallel with the grain, the angular walls intersect the growth rings in a diagonal direction. Such specific structure and angular disposition of the wall portions 26 relative to the grain and growth rings is illustrated in detail in FIG. 5, and it is apparent that no appreciable body length extends along any growth rings or radially of the pole whereby no forces are applied when the insert is installed that are parallel to lines in the poles that will readily split. Inner and outer joining portions 28 and 30, respectively between the angular wall portions 26 are curved and do not apply any appreciable amount of splitting forces. An exemplary contour of the body member for accomplishing the desired results is a star shape with rounded angles.

The present insert is preferably installed in the end of the pole prior to aging of the latter, although installation can be at any stage of seasoning and the advantages will nevertheless be realized. When installed, a barrier is provided against natural checking or cracking. The shape of the insert forces the wood to develop shorter checks 12*a* at more points on the pole surface by forcing stress laterally. Such checking pattern is shown in FIG. 5. A series of small checks will appear close to the periphery but since they are not large checks and do not extend any appreciable distance into the pole, mounting bolts can be safely applied below the insert through any diametral location of the pole.

The specific shape of the insert not only has the advantage of preventing large checks in the wood but is also has the advantage of being inexpensive to manufacture. Such insert is readily installed by driving it into the end of the pole. This can be accomplished rapidly by manual labor. The particular angular relation to the wall portions 26 and their rounded joining portions 28, 30 bind a large inner number of growth rings together to reinforce the end of the pole.

It is to be understood that the form of my invention herein shown and described is to be taken as a preferred example of the same and that various changes in the shape, size and arrangement of parts may be resorted to without departing from the spirit of my invention, or the scope of subjoined claims. The insert preferably is formed from metal but it is to be understood that it can be formed from other materials having the desired qualities of tensile strength for binding the wood and rigidity for driving into the wood.

Having thus described my invention, I claim:

1. In combination, an elongated round wood pole having flat end surfaces, and a check resisting and reinforcing insert, said insert comprising an open ended tubular body member having a continuous defining side wall formed in a star-shape with symmetrical projecting portions and constructed of rigid sheet material of high tensile strength, said body member having a top driving edge and a bottom piercing edge to be driven endwise into the end of said wood pole longitudinally with the grain, said symmetrical projecting portions of said star-shaped body member having defining side walls forming a contour of said body member with a plurality of adjoining wall portions with adjacent ones of said wall portions being disposed angularly relative to each other and all substantially continually intersecting the growth rings of the wood in a diagonal direction relative to the growth rings with the body member embedded endwise in said pole, said wall portions of said side walls being joined by curved wall portions, said symmetrical projecting portions of said body member symmetrically resisting radial checking from all sides around said round wood pole in which said body member is driven and also to reinforce said pole.

* * * * *